US009640861B2

(12) United States Patent
Tseng

(10) Patent No.: US 9,640,861 B2
(45) Date of Patent: May 2, 2017

(54) COUPLING-TYPE ANTENNA

(71) Applicant: MERRY ELECTRONICS (SHENZHEN) CO., LTD., Shenzhen (CN)

(72) Inventor: Chien-Cheng Tseng, Taichung (TW)

(73) Assignee: MERRY ELECTRONICS (SHENZHEN) CO., LTD., Shenzhen (CN)

( * ) Notice: Subject to any disclaimer, the term of this patent is extended or adjusted under 35 U.S.C. 154(b) by 69 days.

(21) Appl. No.: 14/676,060

(22) Filed: Apr. 1, 2015

(65) Prior Publication Data

US 2016/0190677 A1 Jun. 30, 2016

(30) Foreign Application Priority Data

Dec. 29, 2014 (TW) ..... 103146123 A

(51) Int. Cl.

| | |
|---|---|
| ***H01Q 1/38*** | (2006.01) |
| ***H01Q 9/42*** | (2006.01) |
| ***H01Q 5/00*** | (2015.01) |
| ***H01Q 5/378*** | (2015.01) |

(52) U.S. Cl.

CPC ..... *H01Q 1/38* (2013.01); *H01Q 5/378* (2015.01); *H01Q 9/42* (2013.01)

(58) Field of Classification Search

CPC ..... H01Q 5/371; H01Q 5/378; H01Q 9/0407; H01Q 9/0414; H01Q 25/001

See application file for complete search history.

(56) References Cited

U.S. PATENT DOCUMENTS 4,943,811 A * 7/1990 Alden ..... H01Q 1/248 343/810

6,040,803 A * 3/2000 Spall ..... H01Q 1/243 343/700 MS

* cited by examiner

*Primary Examiner* — Graham Smith

*Assistant Examiner* — Daniel J Munoz

(74) *Attorney, Agent, or Firm* — Muncy, Geissler, Olds & Lowe, P.C.

(57) ABSTRACT

A coupling-type antenna includes a substrate having opposing top surface and bottom surface, a monopole antenna element formed on the top surface of the substrate for transmitting a first current and having a feed point and a radiator and a conductor respectively extended from the feed point, and a coupling body formed on the bottom surface of the substrate opposite to the monopole antenna element for transmitting a second current. Further, the transmitting direction of the first current in the monopole antenna element is opposite to the transmitting direction of the second current in the coupling grating body.

2 Claims, 5 Drawing Sheets

COUPLING-TYPE ANTENNA

BACKGROUND OF THE INVENTION

1. Field of the Invention

The present invention relates to antenna technology, and more particularly to a coupling-type grating antenna.

2. Description of the Related Art

With the development of the design trend of mobile electronic devices (such as wireless earphones and wearable devices) toward smaller device size, every component part for mobile electronic device shall be compressed in a smaller space. Further, antennas for mobile electronic device need to use particular operating frequencies and to maintain optical receiving and transmitting frequencies, therefore, the selection and design of antenna patterns will affect the performance of the antenna. Making correct and optimal antenna pattern selection and design are the goal of antenna manufacturers to achieve.

SUMMARY OF THE INVENTION

The present invention has been accomplished under the circumstances in view. It is the main object of the present invention to provide a coupling-type antenna, which has the characteristics of small size and directivity.

To achieve this and other objects of the present invention, a coupling-type antenna comprises a substrate, a monopole antenna element and a coupling body. The substrate comprises a top surface and an opposing bottom surface. The monopole antenna element is formed on the top surface of the substrate and adapted for transmitting a first current, comprising a feed point, and a radiator and a conductor respectively extended from the feed point. The coupling body is formed on the bottom surface of the substrate opposite to the monopole antenna element, and adapted for transmitting a second current. The transmitting direction of the first current in the radiator and the grating conductor is opposite to the transmitting direction of the second current in the coupling grating body.

Thus, the coupling-type grating antenna can be formed in a limited space area; using the design of the opposite relationship between the monopole antenna element and the coupling grating body to have the current transmitting direction in the monopole antenna element be opposite to the current transmitting direction in the coupling body, the far-field leaves off, enabling the radiator of the monopole antenna element to radiate current.

Further, the coupling-type grating antenna can achieve frequency down-conversion using the coupling capacitance produced between the monopole antenna element and the conductor.

Preferably, the coupling body comprises a plurality of notches, thus, the transmitting direction of the second current and the radiating direction of the antenna can be changed by means of changing the configurations of the notches.

Other advantages and features of the present invention will be fully understood by reference to the following specification in conjunction with the accompanying drawings, in which like reference signs denote like components of structure.

DETAILED DESCRIPTION OF THE INVENTION

The composition of the component parts of the present invention and the effects to be achieved by the present invention will be described hereinafter in conjunction with the accompanying drawings, in which the component parts of the coupling-type antenna and their dimensions and appearances are adapted for illustration only but not intended for use to limit the spirit and scope of the present invention.

Figure 1:
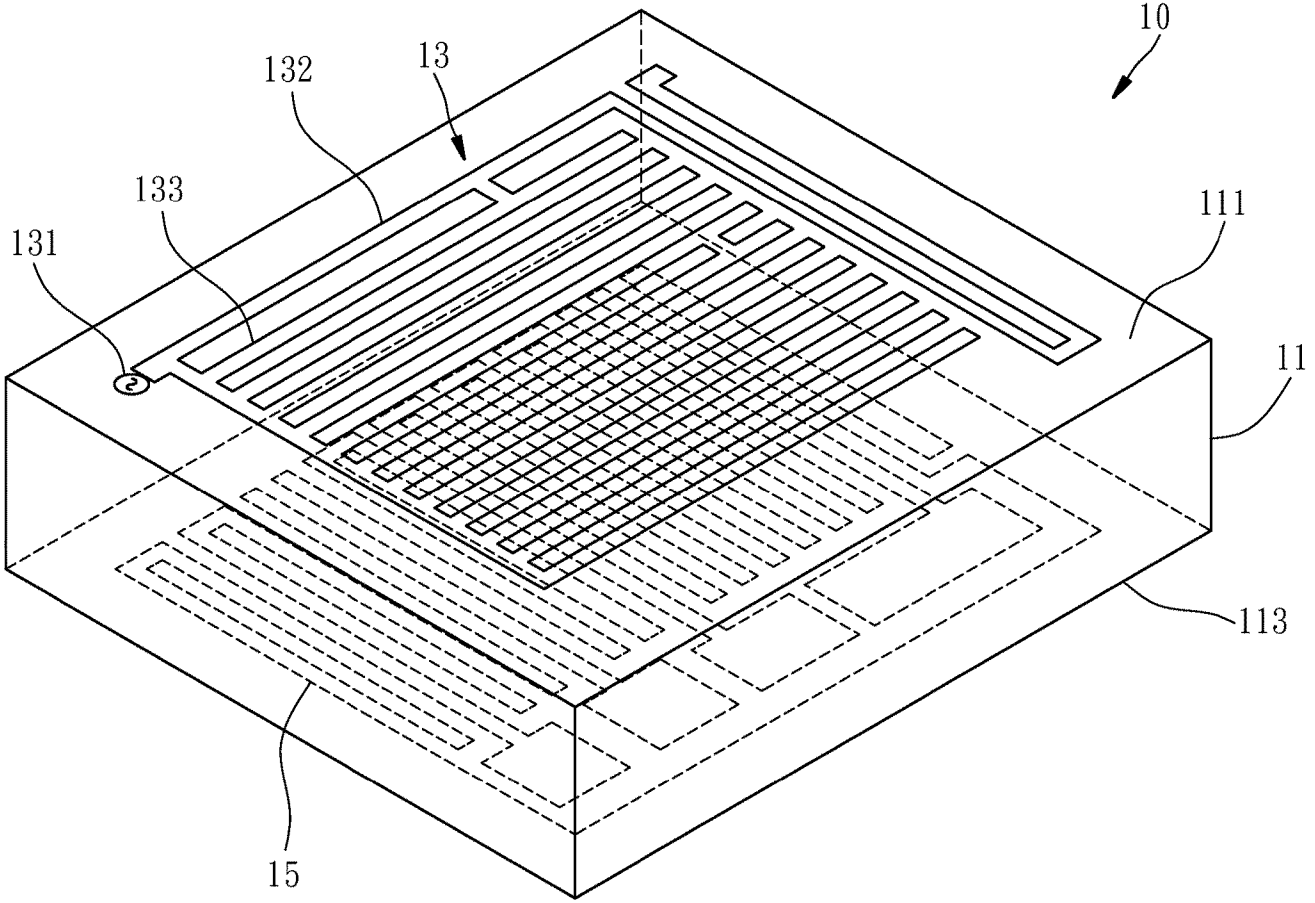
FIG. 1 is a schematic perspective view of a coupling-type antenna In accordance with the present invention.

As illustrated in FIG. 1, a coupling-type antenna 10 in accordance with the present invention comprises a substrate 11, a monopole antenna element 13 and a coupling body 15.

The substrate 11 comprises a top surface 111 and an opposing bottom surface 113. The substrate 11 can be a fiberglass plate (Flame Retardant 4, FR-4) or other insulation plate. In this embodiment, the substrate 11 has a size about 7*7 mm.

Figure 2:
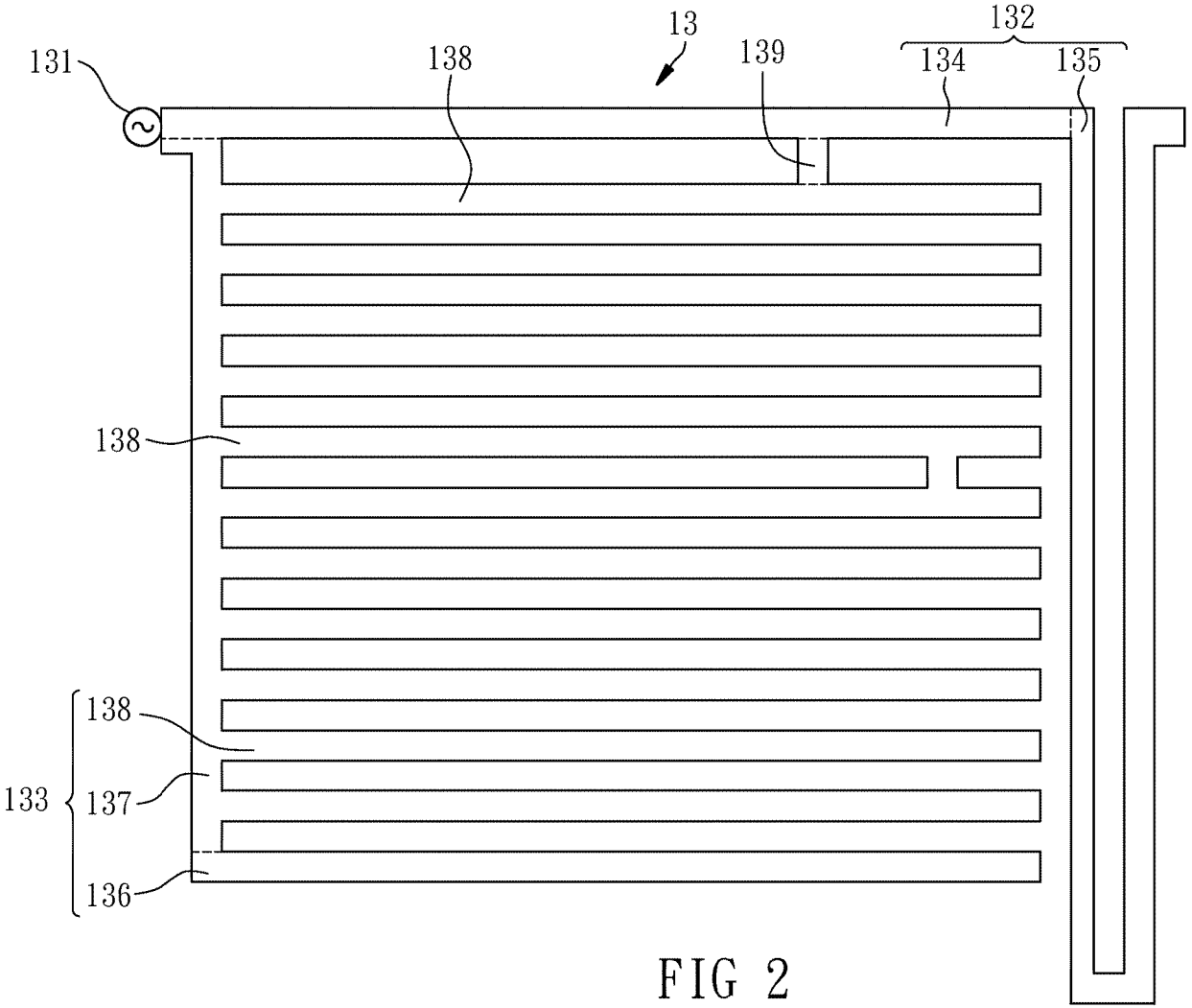
FIG. 2 is a schematic top view of the coupling-type antenna shown in FIG. 1.

The monopole antenna element 13 is formed on the top surface 111 of the substrate 11. As illustrated in FIG. 2, the monopole antenna element 13 is adapted for transmitting a first current, comprising a feed point 131, and a radiator 132 and a conductor 133 respectively extended from the feed point 131. The coupling body 15 is formed on the bottom surface 113 of the substrate 11 opposite to the monopole antenna element 13, and adapted for transmitting a second current. The second current is a coupled current. The transmission direction of the first current in the radiator 132 and the conductor 133 is opposite to the transmission direction of the second current in the coupling body 15. Further, the length of the coupling-type antenna 10 is larger than the width of the coupling-type antenna 10 so that the far-field leaves off, enabling the coupling-type antenna 10 to transmit and receive RF signals exclusively through the radiator 132 of the monopole antenna element 13.

Further, the monopole antenna element 13 and the coupling body 15 are arranged opposite to each other, and thus, frequency down-conversion can be achieved using the coupling capacitance between the monopole antenna element 13 and the coupling grating body 15.

As illustrated in FIG. 2, the radiator 132 of the monopole antenna element 13 comprises a transverse radiator segment 134 and a longitudinal radiator segment 135. The conductor 133 comprises a transverse connection segment 136, a longitudinal connection segment 137 and a plurality of transverse extension segments 138. In the drawing, broken lines are illustrated to define the range of every segment and component, actually, the monopole antenna element 13 is a one-piece element, and therefore, these broken lines do not exit.

The feed point 131 is connected to one end of the transverse radiator segment 134. The longitudinal radiator segment 135 extends from the other end of the transverse radiator segment 134 and goes forward and backward along a longitudinal direction. The longitudinal connection segment 137 extends from the transverse radiator segment 134 to the transverse connection segment 136. The transverse extension segments 138 are respectively extended from the longitudinal connection segment 137 in direction toward the longitudinal radiator segment 135, and spaced from one another in a parallel manner within the area between the transverse radiator segment 134 and the transverse connection segment 136.

The monopole antenna element 13 further comprises a short-circuit conductor 139. The short-circuit conductor 139 extends from the transverse radiator segment 134 to the transverse extension segment 138 that is disposed adjacent to the transverse radiator segment 134, thus, the frequency of the coupling-type antenna can be changed by means of changing the position of the short-circuit conductor 139. In FIG. 2, broken lines are illustrated to define the range of the short-circuit conductor 139, actually, the monopole antenna element 13 is a one-piece element, and therefore, these broken lines do not exit.

In this embodiment, the antenna frequency adjustable range is within 800 MHz to 1 GHz. Positioning the short-circuit conductor 139 relatively closer to the longitudinal radiator segment 135 can obtain a relatively higher antenna frequency. On the contrary, positioning the short-circuit conductor 139 relatively farther from the longitudinal radiator segment 135 can obtain a relatively lower antenna frequency.

Figure 3:
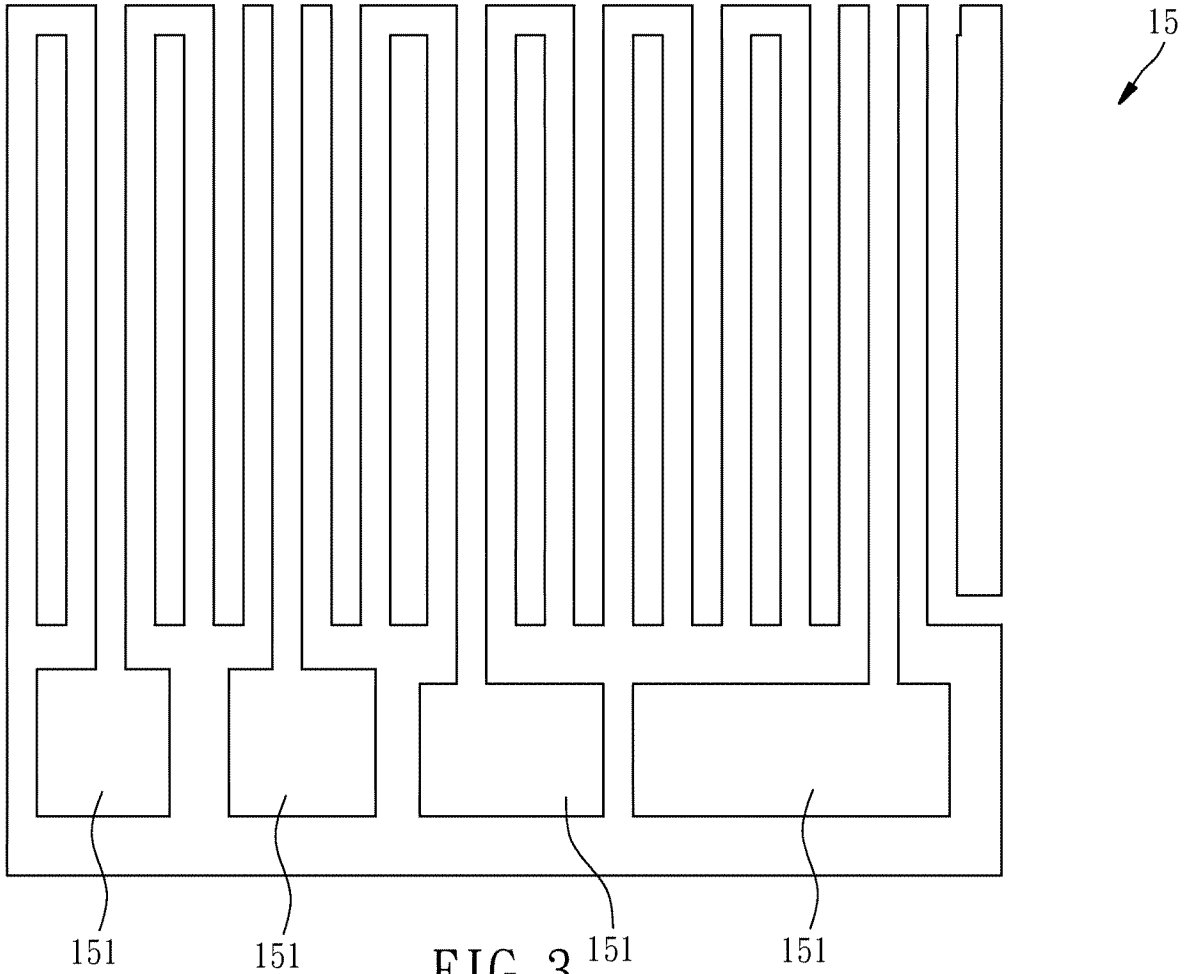
FIG. 3 is a schematic bottom view of the coupling-type antenna shown in FIG. 1.

As illustrated in FIG. 3, the coupling body 15 comprises a plurality of notches 151 Because the coupling body 15 has the notches 151 defined therein, the flowing direction of the second current in the coupling body 15 will be changed subject to the arrangement of the notches 151, in other words, the directivity of the coupling-type grating antenna can be controlled by means of adjusting the number, shape and size of the notches 151 of the coupling body 15 to change the flowing direction of the current.

Figure 4:
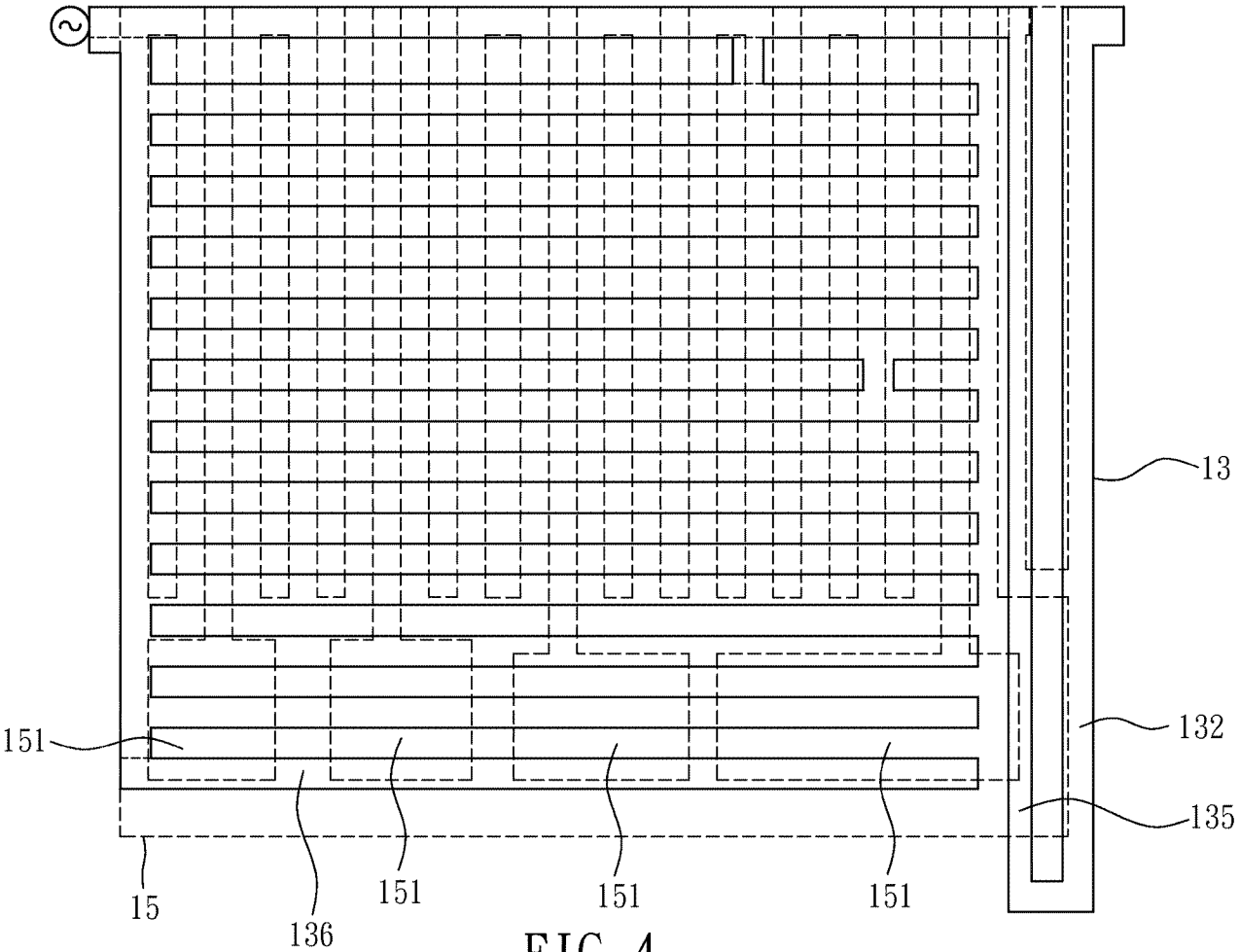
FIG. 4 is a schematic drawing of the present invention, illustrating the substrate shown in FIG. 1 omitted and the monopole antenna element overlapped with the coupling body.

As illustrated in FIG. 4, in which the substrate is omitted and the coupling body 15 is illustrated by a broken line, the projection position of the notches 151 of the coupling body 15 is overlapped with the transverse connection segment 136 of the conductor 133, a part of the transverse extension segment 138 and a part of the longitudinal radiator segment 135 of the radiator 132, and thus, the coupling-type antenna 10 is suitable for Bluetooth applications, i.e., the coupling-type antenna 10 is operable in the 2.4 GHz band. In this embodiment, the projection position of the notches 151 is overlapped with the transverse connection segment 136, a part of the transverse extension segment 138 and a part of the longitudinal radiator segment 135. Alternatively, the notches 151 can be configured to have its projection position be simply overlapped with the transverse connection segment 136, a part of the longitudinal radiator segment 135 to achieve the same effects. Therefore, the design illustrated in FIG. 4 is not intended to limit the scope and spirit of the invention.

Figure 5:
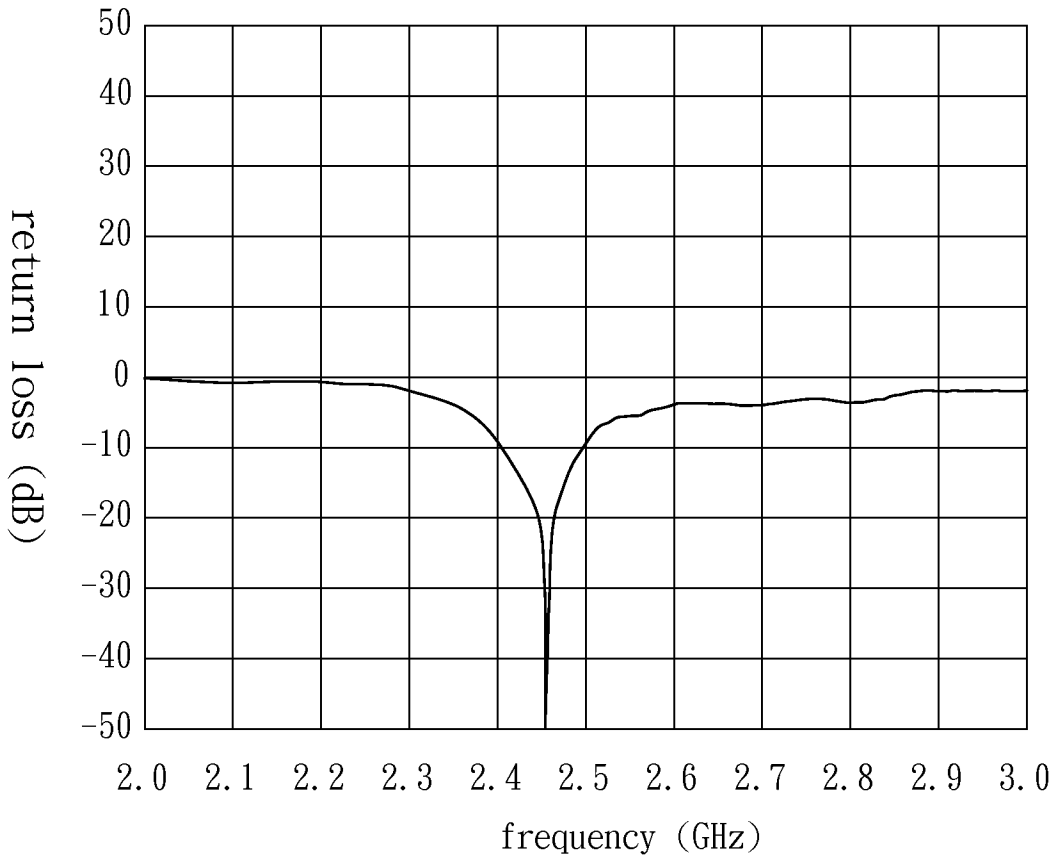
FIG. 5 is a return loss curve of the coupling-type antenna in accordance with the present invention.

Referring to FIG. 5, the return loss of the coupling-type antenna is illustrated. In this embodiment, the coupling-type grating antenna is suitable for Bluetooth applications, i.e., the antenna frequency is in the 2.4 GHz band, and the operating frequency is at about 2.4-2.483 GHz. As illustrated in FIG. 4, the monopole antenna element and coupling body of the coupling-type antenna can be formed in a small size space (i.e., the size of the substrate is about 7*7 mm) for Bluetooth applications.

In conclusion, the coupling-type antenna is directly formed on a substrate using a printed-circuit board manufacturing process, and therefore, the coupling-type antenna has the advantages of ease of manufacturing, low manufacturing cost and planarization.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A coupling-type antenna, comprising:

a substrate comprising a top surface and an opposing bottom surface;

a monopole antenna element formed on said top surface of said substrate comprising a feed point, and a radiator and a conductor respectively extended from said feed point;

a coupling body formed on said bottom surface of said substrate opposite to said monopole antenna element;

wherein said radiator comprises a transverse radiator segment having one end thereof connected to said feed point, and a longitudinal radiator segment extended from an opposite end of said transverse radiator segment and curved forward and backward along a longitudinal direction; said conductor comprises a transverse connection segment, a longitudinal connection segment extended from said transverse radiator segment to said transverse connection segment, and a plurality of transverse extension segments respectively extended from said longitudinal connection segment in direction toward said longitudinal radiator segment and spaced from one another in a parallel manner within the area between said transverse radiator segment and said transverse connection segment;

wherein said monopole antenna element further comprises a short-circuit conductor extended from said transverse radiator segment of said radiator to the said transverse extension segment that is disposed adjacent to said transverse radiator segment;

wherein said coupling body comprises a plurality of notches; and wherein a projection position of said notches of said coupling body is at least overlapped with said transverse connection segment of said conductor and a part of said longitudinal radiator segment of said radiator.

2. The coupling-type antenna as claimed in claim 1, wherein said monopole antenna element and said coupling body are adapted for transmitting a first current and a second current respectively, the transmitting direction of said first current in said longitudinal radiator segment of said radiator and said longitudinal connection segment of said conductor is opposite to the transmitting direction of said second current in said coupling body.

* * * * *